US010136688B2

(12) United States Patent
Ragan

(10) Patent No.: US 10,136,688 B2
(45) Date of Patent: Nov. 27, 2018

(54) GLOVE THERMAL PROTECTION SYSTEM

(71) Applicant: Shelby Group International, Inc., Collierville, TN (US)

(72) Inventor: Thomas G. Ragan, Collierville, TN (US)

(73) Assignee: SHELBY GROUP INTERNATIONAL, INC., Collierville, TN (US)

( * ) Notice: Subject to any disclaimer, the term of this patent is extended or adjusted under 35 U.S.C. 154(b) by 157 days.

(21) Appl. No.: 15/351,236

(22) Filed: Nov. 14, 2016

(65) Prior Publication Data

US 2017/0055609 A1 Mar. 2, 2017

Related U.S. Application Data

(63) Continuation of application No. 13/837,987, filed on Mar. 15, 2013, now Pat. No. 9,510,628.

(51) Int. Cl.
*A41D 19/01* (2006.01)
*A41D 19/015* (2006.01)
(Continued)

(52) U.S. Cl.
CPC ... *A41D 19/01529* (2013.01); *A41D 19/0006* (2013.01); *A41D 31/0027* (2013.01);
(Continued)

(58) Field of Classification Search
CPC ..... A41D 19/01529; A41D 19/0006; A41D 31/0027; A41D 2400/22
See application file for complete search history.

(56) References Cited

U.S. PATENT DOCUMENTS 211,614 A 1/1879 Allerton
1,252,900 A 1/1918 Grinnell
(Continued)

FOREIGN PATENT DOCUMENTS

DE 3922598 1/1991
FR 2215179 8/1974
(Continued)

OTHER PUBLICATIONS

Non-Final Office Action dated May 19, 2014 from U.S. Appl. No. 13/599,887. (17 pages).
(Continued)

*Primary Examiner* — Richale Quinn
(74) *Attorney, Agent, or Firm* — Neal, Gerber & Eisenberg LLP; Thomas E. Williams

(57) ABSTRACT

A construction for a glove or other article of clothing for use in hazardous environments is disclosed, comprising a first layer comprising a laminate that includes an inner layer comprising a woven, nonwoven, or knit material, an intermediate layer comprising a barrier to the passage therethrough of liquids that overlies the inner layer, and a thermal layer affixed to and overlying the intermediate layer in at least a portion of a bridge area. The thermal layer is approximately 0.30 mm thick. The construction also includes a second layer attached to and overlying the first layer to form an outer portion for the glove or other article of clothing. The first layer and the second layer combined provides a thermal protection performance (TPP) of at least approximately 75% greater than a reference combination of the first and the second layer that does not include the thermal layer.

20 Claims, 5 Drawing Sheets

(51) Int. Cl.
*A41D 19/00* (2006.01)
*A41D 31/00* (2006.01)

(52) U.S. Cl.
CPC ..... *A41D 2400/22* (2013.01); *A41D 2500/10* (2013.01); *A41D 2500/20* (2013.01); *A41D 2500/30* (2013.01)

(56) References Cited

U.S. PATENT DOCUMENTS

| | | | |
|---|---|---|---|
| 2,004,382 | A | 6/1935 | Palicki |
| 2,072,541 | A | 3/1937 | Burnham |
| 2,194,934 | A | 3/1940 | Geissmann |
| 2,446,921 | A | 8/1948 | Grant |
| 2,561,891 | A | 7/1951 | Tucker |
| 2,578,188 | A | 12/1951 | Ionides et al. |
| 3,014,980 | A | 12/1961 | Marshall et al. |
| 3,098,237 | A | 7/1963 | Slimovitz |
| 3,114,915 | A | 12/1963 | Gross |
| 3,625,790 | A | 12/1971 | Ayres |
| 3,869,726 | A | 3/1975 | Bell |
| 3,879,764 | A | 4/1975 | Weber-Liel |
| 4,194,041 | A | 3/1980 | Gore et al. |
| 4,197,592 | A | 4/1980 | Klein |
| 4,209,857 | A | 7/1980 | Clark, Jr. et al. |
| 4,355,424 | A | 10/1982 | McCoy, Jr. |
| 4,370,365 | A | 1/1983 | Takamizawa et al. |
| 4,430,759 | A | 2/1984 | Jackrel |
| 4,433,439 | A | 2/1984 | Sidman et al. |
| 4,454,611 | A | 6/1984 | Tschirch et al. |
| 4,520,056 | A | 3/1985 | Jackrel |
| 4,545,841 | A | 10/1985 | Jackrel |
| 4,559,646 | A | 12/1985 | Ertl |
| 4,583,248 | A | 4/1986 | Edwards et al. |
| 4,679,257 | A | 7/1987 | Town |
| 4,733,413 | A | 3/1988 | Dykstra |
| 4,847,918 | A | 7/1989 | Sturm |
| 4,918,756 | A | 4/1990 | Grilliot et al. |
| 5,020,161 | A | 6/1991 | Lewis, Jr. et al. |
| 5,020,162 | A | 6/1991 | Kersten et al. |
| 5,088,124 | A | 2/1992 | Dutchik |
| 5,123,119 | A | 6/1992 | Dube |
| 5,153,055 | A | 10/1992 | Ko |
| 5,349,705 | A | 9/1994 | Ragan |
| 5,361,415 | A | 11/1994 | Deering et al. |
| 5,560,044 | A | 10/1996 | Masley |
| 5,566,405 | A | 10/1996 | Masley |
| 5,569,507 | A | 10/1996 | Goodwin et al. |
| 5,598,582 | A | 2/1997 | Andrews et al. |
| 5,603,119 | A | 2/1997 | Rinehart |
| 5,640,718 | A | 6/1997 | Aldridge |
| 5,700,544 | A | 12/1997 | Goodwin et al. |
| 5,732,413 | A | 3/1998 | Williams |
| 5,740,551 | A | 4/1998 | Walker |
| 5,766,400 | A | 6/1998 | Gallagher, Jr. |
| 5,819,316 | A | 10/1998 | Aldridge |
| 5,822,795 | A | 10/1998 | Gold |
| 5,822,796 | A | 10/1998 | Harges, Jr. et al. |
| 5,851,683 | A | 12/1998 | Plamthottam et al. |
| 5,935,882 | A | 8/1999 | Fujita et al. |
| 5,981,019 | A | 11/1999 | Goodwin et al. |
| 6,021,523 | A | 2/2000 | Vero |
| 6,048,810 | A | 4/2000 | Baychar |
| 6,154,886 | A | 12/2000 | Hottner |
| 6,155,084 | A | 12/2000 | Andrews et al. |
| 6,243,875 | B1 | 6/2001 | French |
| 6,591,427 | B1 | 7/2003 | Bennett |
| 6,637,035 | B1 | 10/2003 | Brinkmann et al. |
| 6,718,556 | B2 | 4/2004 | Zuckerwar et al. |
| 6,792,625 | B2 | 9/2004 | Hexels |
| 6,871,359 | B2 | 3/2005 | Han |
| 7,125,816 | B1 | 10/2006 | Baychar |
| 7,225,473 | B2 | 6/2007 | Schierenbeck et al. |
| 7,644,448 | B2 | 1/2010 | Grilliot et al. |
| 7,784,113 | B2 | 8/2010 | Ragan et al. |
| 9,066,545 | B2 | 6/2015 | Klug et al. |
| 9,072,325 | B2 | 7/2015 | Ragan |
| 2002/0073474 | A1 | 6/2002 | Geng |
| 2003/0015275 | A1 | 1/2003 | Phillips et al. |
| 2003/0106133 | A1 | 6/2003 | Novak |
| 2004/0098786 | A1 | 5/2004 | Hottner et al. |
| 2006/0117457 | A1 | 6/2006 | Williams et al. |
| 2007/0124849 | A1 | 6/2007 | Williams et al. |

FOREIGN PATENT DOCUMENTS

| | | |
|---|---|---|
| JP | 5153938 | 6/1993 |
| JP | 2004051723 | 2/2004 |

OTHER PUBLICATIONS

Shelby Fire and Rescue Gloves, Barrier Attachment Methods [online], [retrieved on Jun. 26, 2012]. Retrieved from the Internet <URL: http://www.shelbyglove.com/shelby-FDP/index.hmtl>, p. 8.

Shelby Fire and Rescue Gloves, Barrier Attachment Methods [online], [retrieved on Jun. 26, 2012]. Retrieved from the Internet <URL: http://www.shelbyglove.com/shelby-FDP/index.html>, p. 8.

FIG. 4

| Layup No. | Layer No. | Layup Composition | Uncompressed Thickness | Compressed Thickness | TPP |
|---|---|---|---|---|---|
| 1 | 1 | Split Cowhide | 4.40 mm | 2.35 mm | 42 |
| | 2 | Gore® RT7100 | | | |
| | 3 | SEF (8 oz) | | | |
| | | | | | |
| 2 | 1 | Split Cowhide | 4.60 mm | 2.50 mm | 47 |
| | 2 | Gore® RT7100 | | | |
| | 3 | SEF (10 oz) | | | |
| | | | | | |
| 3 | 1 | Split Cowhide | 6.20 mm | 3.15 mm | 50 |
| | 2 | Gore® RT7100 | | | |
| | 3 | SEF (8 oz) | | | |
| | 4 | SEF (8 oz) | | | |
| | | | | | |
| 4 | 1 | Kevlar simplex knit | 8.00 mm | 3.05 mm | 74 |
| | 2 | Gore® RT7100 | | | |
| | 3 | Rochelle spacer | | | |
| | 4 | Gore® Crosstech® Direct Grip | | | |
| | | | | | |
| 5 | 1 | Split Cowhide | 4.60 mm | 2.70 mm | 80+ |
| | 2 | Gore® T4999 Tape | | | |
| | 3 | Gore® RT7100 | | | |
| | 4 | SEF (8 oz) | | | |

GLOVE THERMAL PROTECTION SYSTEM

CROSS REFERENCE

This application is a continuation of U.S. patent application Ser. No. 13/837,987, which was filed on Mar. 15, 2013, and entitled "GLOVE THERMAL PROTECTION SYSTEM", which is incorporated herein by reference in its entirety.

BACKGROUND

This application relates generally to the field of thermal protection layers, and more particularly to thermal protection layers provided as part of an article of clothing, such as gloves and the like, for protecting a wearer from heat and/or fire.

As part of their job, firefighters may be exposed to extreme heat and hazardous environments when responding to a fire. The clothing firefighters wear must therefore be designed to protect against these extremes. The specialized gloves worn by firefighters may exhibit a number of characteristics to ensure that they adequately perform in such environments during use. Such gloves may include a plurality of layers joined together where each layer is constructed to provide a particular performance characteristic group of characteristics, such as breathability, durability, heat resistance, abrasion resistance, and the like. For example, an outermost shell or layer of the glove may be fabricated from a tough, abrasion-resistant and likely heat-resistant material that shields the hand from heat and permits any gripping or grasping that might be required by the wearer. Inside this outer layer, a moisture barrier layer may be provided to prevent the firefighter's hands and any intervening layers within the glove from being soaked with water or from being contaminated or damaged by potentially dangerous liquids, such as blood, solvents, or other chemical liquids. Alternatively or in addition to the moisture barrier layer, one or more additional layers may be provided inside the outer layer (and/or inside the moisture barrier layer, if provided). This layer may be formed from a soft yet heat-resistant material which may provide a degree of padding for the wearer's hand. Multiple-layer gloves are worn by a variety of users in other industries or for purposes other than firefighting where multiple layers may provide additional protection or utility for the wearer or the wearer's hands.

In the past, to improve thermal performance of a glove system to meet or exceed standards set by the federal Occupational Safety and Health Administration (OSHA), the California Occupational Safety and Health Administration (Cal/OSHA), and/or the National Fire Protection Association® (NFPA®), the manufacturer of the glove must either increase the thickness of existing glove layers, increase the number of the same heat resistant layers, or do both to inhibit conduction of heat to the wearer. However, increasing the thickness of existing glove layers or adding layers to boost thermal resistance performance results in increased bulk of the glove, particularly in and around the fingers and fingertips. But as bulk of the glove increases, dexterity of the wearer's hand and fingers tend to decrease.

SUMMARY

A construction for a glove for use in hazardous environments is disclosed, comprising a first layer comprising a laminate that includes an inner layer comprising a woven, nonwoven, or knit material, an intermediate layer comprising a barrier to the passage therethrough of liquids and which at least partially or completely overlies the inner layer, and a thermal layer affixed to and overlying the intermediate layer in at least a portion of a bridge area. The thermal layer is approximately 0.20-0.35 mm thick. The construction also includes a second layer attached to and overlying the first layer to form an outer portion for the glove. The first layer and the second layer combined provides a thermal protection performance (TPP) of at least approximately 75% greater than a reference combination of the first and the second layer that does not include the thermal layer.

The woven, nonwoven, or knit material may include a self extinguishing fleece having up to an approximately 8 oz fabric weight. The intermediate layer may be water vapor permeable to permit perspiration of the wearer of the glove to pass therethrough. The intermediate layer may also be a barrier to transmission therethrough by liquids including blood or liquid hazardous chemicals.

The thermal layer may have an abrasion resistance of at least 100 cycles upon application of a 500 gram load to the surface of the thermal layer. The thermal layer may include a tape. The first layer may be capable of resisting a puncture of at least approximately 20 Newtons.

The second layer may include a leather or a synthetic material including poly para-phenyleneterephthalamide.

In another embodiment, a construction for a glove for use in hazardous environments is disclosed, comprising a first layer comprising a laminate that includes an inner layer having a woven, nonwoven, or knit material with a flame extinguishing property, an intermediate layer attached to and overlying the inner layer, a thermal layer affixed to and overlying the intermediate layer in at least a portion of a bridge area, and a second layer attached to and overlying the first layer to form an outer portion for the glove. The intermediate layer is a barrier to passage therethrough of liquids. The thermal layer is approximately 0.30 mm thick. The first layer and the second layer combined is approximately 4.6 mm thick when uncompressed while providing a thermal protection performance (TPP) of at least 80 to minimize bulk and maximize dexterity of a wearer of the glove.

The woven, nonwoven, or knit material may include a self extinguishing fleece having up to an approximately 8 oz fabric weight. The thermal layer may have an abrasion resistance of at least 100 cycles upon application of a 500 gram load. The thermal layer may include a tape. The first layer may be resistant to puncture to at least approximately 20 Newtons. The second layer may include an approximately 3.5-3.75 oz leather.

In another embodiment, a construction for a glove for use in hazardous environments is disclosed, comprising a first layer having a laminate that includes an inner layer comprising a flame inhibiting material, an intermediate layer overlying the inner layer, a thermal layer comprising a tape that is affixed to and overlies the intermediate layer in at least a portion of a bridge area, and a second layer attached to and overlying the first layer to form an outer portion for the glove. The intermediate layer may be breathable and includes a barrier to passage therethrough of liquids. The first layer and the second layer combined provides a thermal protection performance (TPP) of at least 50 and at least approximately 75% greater than a reference combination of the first and second layers that does not include the thermal layer.

The inner layer may include a self extinguishing fleece comprising an approximately 8 oz fabric weight. The liquids that are barred from passing through the barrier layer may include blood and/or liquid hazardous chemicals. The first layer may include an abrasion resistance of at least 100 cycles upon application of a 500 gram load. The first layer may be capable of resisting a puncture load of at least approximately 20 Newtons. The second layer may include an approximately 3.5-3.75 oz leather.

In yet another embodiment, a construction for a glove for use in hazardous environments is disclosed, comprising a first layer comprising a flame inhibiting material, a second layer connected to the first layer, a third layer connected to the first and second layers, and a fourth layer comprising a tape that is affixed to either the first layer, the second layer or the third layer to cover at least a portion of a bridge area. The second layer may be breathable and includes a barrier to passage therethrough of liquids. A combination of the first, second, third, and fourth layers provides a thermal protection performance (TPP) of at least 40 and at least approximately 75% greater than a reference combination of the first, second and third layers.

The first layer may include a self extinguishing fleece comprising an approximately 8 oz fabric weight. The second layer may pose a barrier to the passage therethrough of blood or liquid hazardous chemicals. An uncompressed thickness of a combination of the first, second, and third layers is approximately 1.35 mm. An uncompressed thickness of a combination of the first, second, third, and fourth layers is approximately 1.70 mm. The third layer may include an approximately 0.50 mm thick aluminized PBI/Kevlar material.

BRIEF DESCRIPTION OF THE DRAWINGS

FIG. 4 illustrates thermal protection performance test results associated with various glove layups.

DETAILED DESCRIPTION

Figure 1:
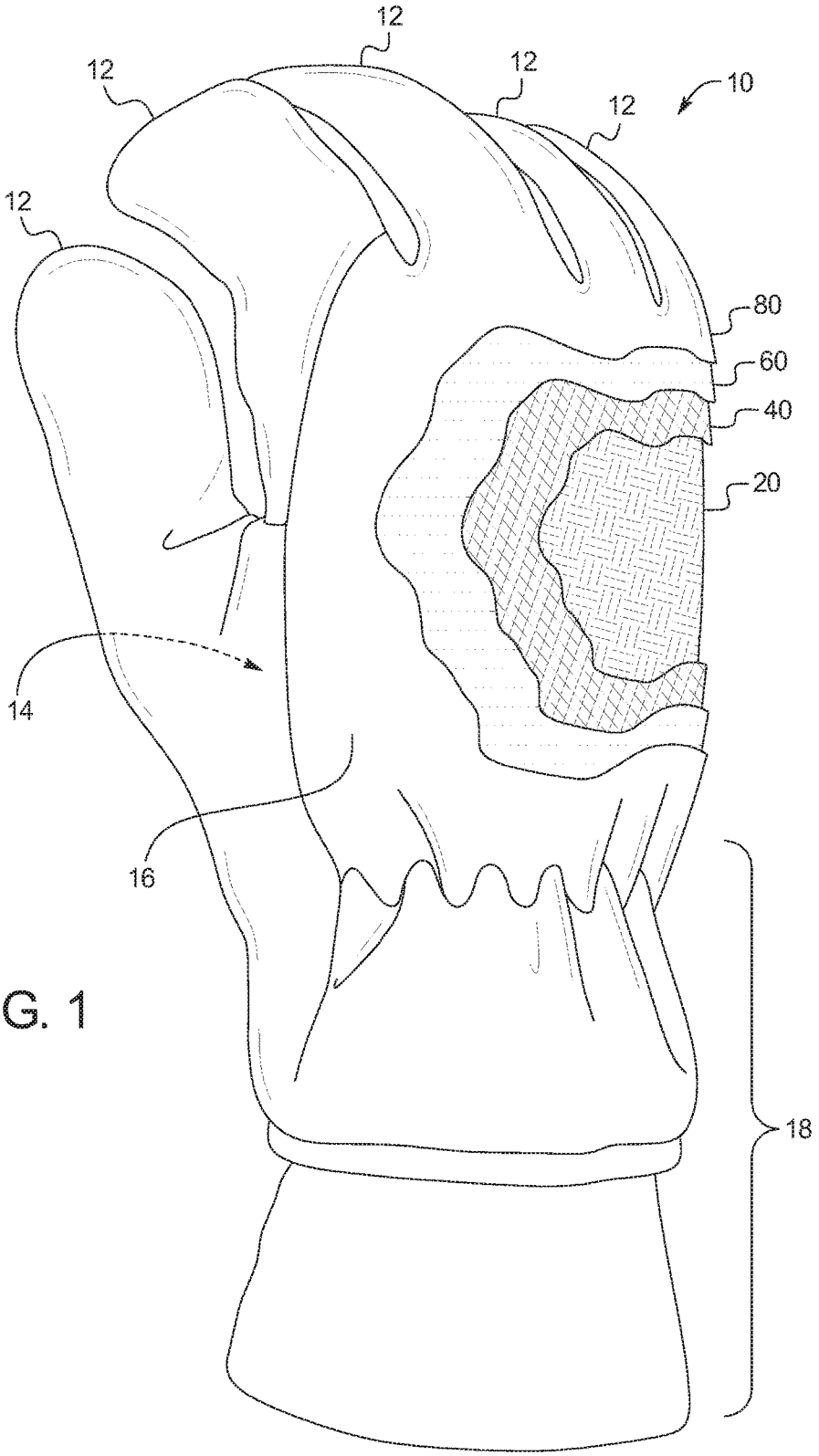
FIG. 1 is a partially cut away perspective view showing an embodiment of a multi-layer glove.

Although the figures and the instant disclosure describe one or more embodiments of a thermal protection system, one of ordinary skill in the art would appreciate that the teachings of the instant disclosure would not be limited to these embodiments. For example, the teachings of the instant disclosure may be applied to any article of clothing.

Turning now to the figures, wherein like reference numerals refer to like elements, there is shown one or more embodiments of a multi-layer glove comprising a thermal protection system for protecting a wearer from high temperatures and hazardous environments while promoting hand, finger, and fingertip dexterity through minimizing bulk of the glove apparatus.

Referring to FIG. 1, there is shown an exemplary multi-layer glove 10. Glove 10 includes five finger portions 12 including the thumb, palm portion 14 (not shown), dorsal portion 16, and wrist portion 18. In other embodiments, wrist portion 18 may comprise any of a number of different constructions known in the art. Likewise, in other embodiments, glove 10 may have other numbers of finger portions 12 or none at all like a mitten. It will be understood that reference to a "finger" or a "fingertip" relates to any or all of the digits of any layer of glove 10, and further includes the portion surrounding a wearer's fingers if glove 10 is configured as a mitt. Although glove 10 is illustrated as being a right hand glove, it would be appreciated that the instant disclosure is applicable to a left hand glove as well. Those of ordinary skill will appreciate that gloves made in accordance with the disclosure herein can extend for any length down the wearer's arm, from gloves that end at about the wrist of the wearer, to relatively long gauntlet-styles or other constructions which may integrate a portion of glove 10 with another garment.

As illustrated in the broken away portion of the embodiment of FIG. 1, glove 10 includes inner layer 20, barrier layer 40, thermal layer 60, and outer layer 80. Inner layer 20 is the innermost layer over which lies barrier layer 40. Thermal layer 60 is shown as lying over barrier layer 40, and outer layer 80 is shown as lying over thermal layer 60 to form glove 10. Glove 10 may include fewer or greater number of layers. For example, glove 10 may omit barrier layer 40 if, for example, the intended use does not call for protection from moisture or hazardous liquids or vapors or if one of the other layers of glove 10 inherently incorporates or otherwise includes protection from moisture or hazardous liquids.

Outer layer 80 comprises any abrasion resistant material, such as leather, canvas, Kevlar®, and the like, or any other suitable material that offers the required protection or performance in extreme conditions. Outer layer 80 shown in the figures may include multiple pieces stitched together. Outer layer 80 may also include fabric that overlaps other portions of outer layer 80 or which covers other portions of outer layer 80. In one embodiment, a piece of fabric may be stitched over an outer surface of one or more finger portions 12 to provide additional abrasion or wear resistance or protection to a wearer's fingers. In another embodiment, one or more finger portions 12 may comprise multiple sections of fabric stitched or otherwise joined together to form the one or more finger portions 12. For example, the top portion of an index finger portion of outer layer 80 may be stitched to a lower portion of the index finger portion to form a stitch line at or near a knuckle of the wearer to produce a hinge for ease of motion of glove 10 by the wearer. Outer layer 80 may comprise any number of fabric weights, including a 3.5-3.75 oz leather.

Inner layer 20 comprises a knitted, woven, or nonwoven material and may include wool, polyethylene or any numerous known or yet to be developed organic or inorganic fibers and fabrics. Inner layer 20 may include a felt-like texture on its inside surfaces for wearer comfort and a relatively smooth texture on its outside surfaces to enhance adhesion thereto of barrier layer 40, if present. Inner layer 20 may have flame resistant or flame retardant properties and may resist heat transfer therethrough to act as a thermal lining on its own merits as a part of the overall thermal resistance of glove 10. Such properties may arise either as inherent properties of the fiber or material from which inner layer 20 is made, or due to one or more coatings or thermal laminations applied to the outer surface of inner layer 20. In one embodiment, inner layer 20 comprises self extinguishing brushed fleece (SEF) to provide a measure of flame and heat resistance as well as comfort to a wearer of glove 10. Inner layer 20 may comprise any number of fabric weights, such as 4 oz, 8 oz, 10 oz and the like. Style F106 modacrylic fleece and style F550 Kevlar®, a material comprising poly para-phenyleneterephthalamide, from Draper Knitting Company are each suitable materials for inner layer 20. Style F106 modacrylic fleece, for example, is a self extinguishing fabric with a brushed fleece surface on one side and a relatively smooth surface on the other. Style F106 modacrylic fleece is approximately 0.70 mm thick and is flexible and conformable to a wearer's hand.

Figure 2:
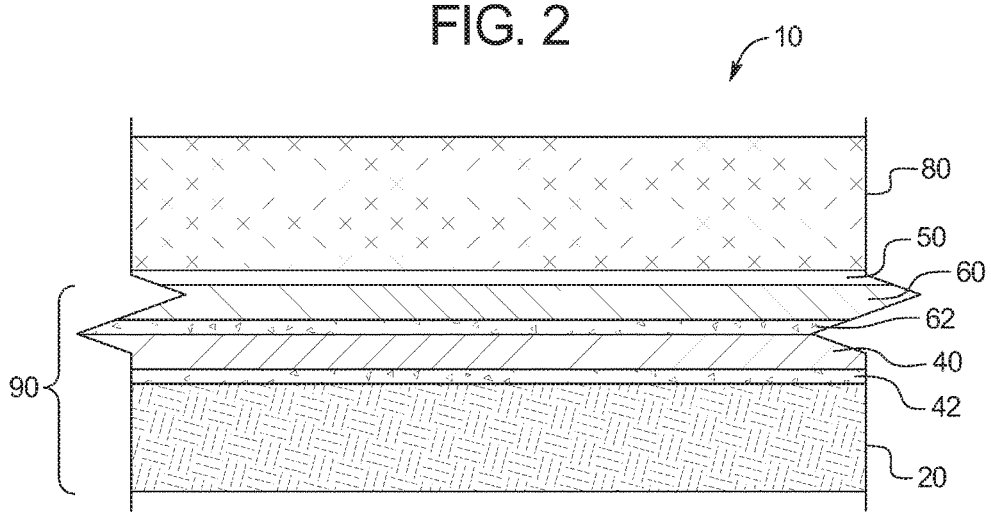
FIG. 2 is a cross sectional view of an embodiment of the multi-layer glove of FIG. 1.

A laminate such as a film or a coating may be applied or adhered to the outside surfaces of inner layer 20 to serve as a barrier to moisture, harmful liquids, and/or chemicals. In one embodiment, barrier layer 40 is laminated and/or adhered to the outer surfaces of inner layer 20 using a suitable adhesive 42. In another embodiment, barrier layer 40 comprises a shell that completely encases inner layer 20 and is connected to by, for example, stitches to inner layer 20. Barrier layer 40 comprises a material that is completely waterproof, such as a polyethylene, microporous polyether urethane or expanded polytetrafluoroethylene (PTFE) film, or may be formed from a breathable material that is impervious to liquid but permeable to water vapor such that perspiration from the hands may escape through inner layer 20, through barrier layer 40 and ultimately through outer layer 80 to the outside of glove 10. In another embodiment, barrier layer 40 comprises a chemical treatment applied to a glove layer to cause the layer to resist penetration or transmission of water or vapor therethrough, but which may not truly render the glove layer waterproof or vaporproof. Barrier layer 40 may comprise thermal protection properties. Barrier layer 40 may also provide a barrier to blood or other biohazards, or one or more types of hazardous chemicals, such as caustic solutions, solvents, dyes, industrial wastes and the like. As would be appreciated by one of ordinary skill, certain barrier materials are more resistive to particular classes of hazardous chemicals than others. The choice of a barrier material may depend upon the anticipated types of hazards to which the wearer may be exposed. Thus, as used herein, the term "barrier layer" includes materials that are resistant to one or more types of hazardous liquids, chemicals, viruses, bacteria, and the like. Gore® RT7100 material, which is available from W. L. Gore & Associates, Inc., is a suitable material for barrier layer 40. Gore® RT7100 material includes adhesive 42 on one side for adhering to inner layer 20 and a smooth surface on the other side for receiving adhesive backed thermal layer 60, as shown in the embodiment of FIG. 2. Gore® RT7100 material is approximately 0.02-0.08 mm (~1-3 mil) thick, is flexible, and conforms to the shape of inner layer 20 when adhered thereon. Other suitable materials for barrier layer 40 include Gore® Crosstech® film technology insert and Gore® Crosstech® insert.

Figure 3:
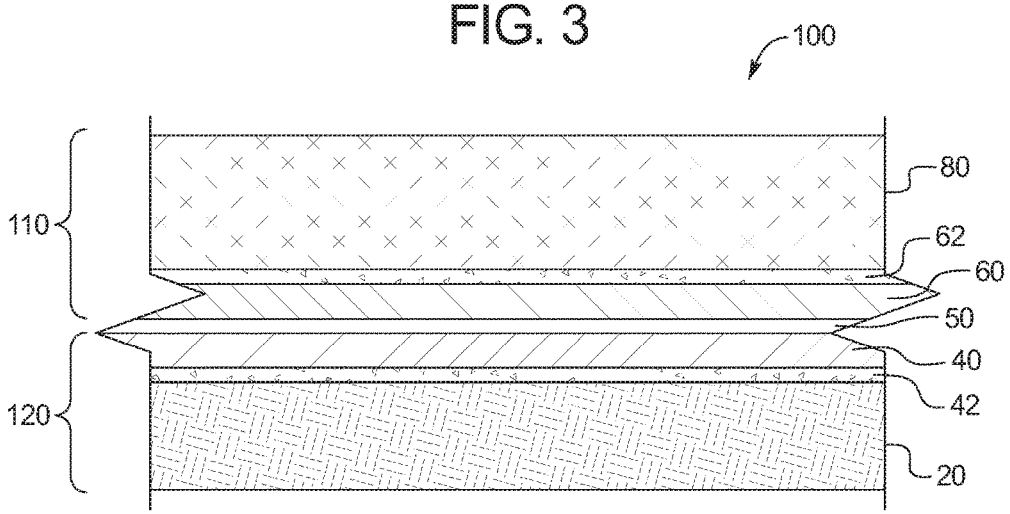
FIG. 3 is a cross sectional view of another embodiment of the multi-layer glove of FIG. 1.

As shown in the embodiment of FIG. 2, thermal layer 60 includes adhesive 62 on one side for adhering to outer surfaces of barrier layer 40. Alternatively, as shown in the embodiment of FIG. 3, thermal layer 60 is adhered to inner surfaces of outer layer 80 by adhesive 62. Thermal layer 60 may alternatively be adhered to outer surfaces of inner layer 20 if separate barrier layer 40 is not present.

To form inner portion 90 comprising inner layer 20, barrier layer 40, and thermal layer 60, barrier layer 40 is affixed or otherwise laminated to inner layer 20 using adhesive 42, and thermal layer 60 is affixed or otherwise laminated to barrier layer 40 using adhesive 62. Inverted outer layer 80 is then attached to inner portion 90, then folded over inner portion 90 to form glove 10. Although gap 50 is notionally shown therebetween, inner surfaces of outer layer 80 and outer surfaces of inner portion 90 may be and likely are in contact with one another, depending on the dimensions and tolerances of the patterns associated with outer layer 80 and inner portion 90. In other embodiments, barrier layer 40 is not affixed or otherwise laminated to inner layer 20 using adhesive 42 and instead is connected to inner layer 20 by, for example, stitching the components together, then folding barrier layer 40 over inner layer 20.

When clutching an object, a wearer's closed or partially closed hand tends to cause extension of the glove layers located on the top and/or along at least the bridge portion of the hand, which tends to flatten the layers as the layers bend around the wearer's knuckles, resulting in less thermal protection in these areas. To protect a wearer of glove 10 while maximizing dexterity and minimizing glove bulk, thermal layer 60 may be positioned to cover at least the knuckles of the wearer's fist, or larger areas such as the entirety of the bridge or back of the wearer's hand. Thermal layer 60 may extend down finger portions 12, for example, along at least the top surface of the wearer's fingers to provide additional protection in these areas without sacrificing a wearer's finger or hand dexterity. In some embodiments, thermal layer 60 comprises a shell that encases barrier layer 40, if present, and inner layer 20.

In one embodiment, to minimize bulk of glove 10 and particularly over the bridge and knuckle portions so as to maintain flexibility and dexterity of the hands and fingers of a wearer of glove 10, thermal layer 60 comprises Gore® tape Model T-4999 without dry edge, which is available from W. L. Gore & Associates, Inc. In other embodiments, thermal layer 60 of glove 10 may include any material that provides the benefits described below.

Gore® tape Model T-4999 is approximately 0.30 mm (~0.01 inch) thick, flexible, and is a rip and/or tear resistant material that conforms to the surface to which it is adhered. Gore® tape Model T-4999 combines a durable Gore® laminate with a pressure sensitive adhesive for durable adhesion in relatively hot, cold and wet environments. Gloves and garments comprising Gore® tape Model T-4999 meet NFPA 1971 standards when Gore® tape Model T-4999 is used or incorporated in such gloves or garments as described herein. The adhesive properties of thermal layer 60 avoids requiring stitching to an adjacent layer. The adhesive properties of thermal layer 60 also avoids shifting of thermal layer 60 relative to adjacent layers during use by a wearer over time thereby offering continuous protection in all areas of glove 10 for the life of glove 10 without incurring any unprotected areas to the wearer over time. Surprisingly, use of thermal layer 60 comprising Gore® tape Model T-4999 or any functionally and proportionally similar material provides substantially improved thermal protection performance over the use of traditional fabrics and glove constructions—without the need to add additional layers or bulk to increase the thermal protection performance value of gloves—while maintaining or improving a wearer's finger dexterity by minimizing glove layer bulk as would otherwise occur. Thermal layer 60 may provide these performance benefits without affecting the flexibility of barrier layer 40.

To highlight the improved thermal protection offered by the use of thermal layer 60 comprising Gore® tape Model T-4999 or any material having physical and/or mechanical properties similar to Gore® tape Model T-4999, there is shown in FIG. 4 thermal protection performance (TPP) test results for each of five different exemplary glove or garment layer combinations while also comparatively showing the relative bulk thicknesses of each glove or garment layer combination. In a baseline test, layup #1 includes a select grade, 3.5 to 3.75 oz split cowhide outer layer, a Gore® RT7100 barrier layer, and an 8 oz, self extinguishing fleece inner layer. The uncompressed thickness of layup #1, which represents the thickness on a wearer's hand, measured 4.40 mm, while the compressed thickness measured 2.35 mm. The TPP for layup #1 measured 42.

Layup #2 includes all of the same features as layup #1 except it includes a 10 oz self extinguishing fleece inner layer rather than an 8 oz self extinguishing fleece inner layer. The uncompressed and compressed thickness measurements increased to 4.60 mm and 2.50 mm, respectively, as did the TPP measurement (47). This test shows that modestly increasing the weight and thickness of the self extinguishing fleece inner layer results in a modest improvement in thermal protection performance.

Layup #3 includes all of the same features as layup #1 except it includes an additional 8 oz layer of self extinguishing fleece. The uncompressed and compressed thickness measurements increased substantially to 6.20 mm and 3.15 mm, respectively, but the TPP measurement only modestly improved to 50. This test shows that increasing the number and thickness of glove or garment layers, which means increase bulk and less dexterity, results in another modest improvement in thermal protection performance. More specifically, a 41% increase in uncompressed layer thickness resulted in only a 19% improvement in TPP over the results of the baseline layup #1.

Layup #4 includes a Kevlar® simplex knit outer layer, a Gore® RT7100 barrier layer, a Rochelle spacer layer, and a Gore® Crosstech® direct grip inner layer. The uncompressed thickness measurement increased substantially over layup #3 to 8.00 mm, while the compressed thickness measurement slightly decreased to 3.05 mm. The TPP measurement for layup #4 sizably increased to 74, but at a significant amount of bulkiness that a wearer would experience, as evidenced by a nearly doubling of the uncompressed thickness as compared to layup #1.

Layup #5 is identical to layup #1 except layup #5 includes a thermal layer of Gore® T-4999 tape positioned between the Gore® RT7100 barrier layer and the split cowhide outer layer. The uncompressed and compressed thickness measurements increased modestly to 4.60 mm and 2.70 mm, respectively, as compared to layup #1, but the measured TPP doubled to approximately 80+. This test shows that the use of thermal layer 60 comprising Gore® tape Model T-4999 or any material having physical and/or mechanical properties similar to Gore® tape Model T-4999 substantially improves thermal protection performance without appreciably adding to the bulk thickness of the glove or garment thereby maximizing a wearer's dexterity.

More specifically, with the addition of a thermal layer, layup #5 is only approximately 5% thicker than the baseline layup #1, but provides a TPP that is at least approximately 90% greater than the baseline layup #1. As compared to layup #2, layup #5 has approximately the same uncompressed thickness but provides at least approximately a 70% increase in TPP. As compared to layup #3, layup #5 is approximately 26% thinner in uncompressed thickness but provides at least approximately a 60% increase in TPP. Lastly, as compared to layup #4, layup #5 is approximately 43% thinner in uncompressed thickness but provides at least approximately an 8% increase in TPP.

Each of these layups was also subjected to being soaked in water for 24 hours. Of these, layup #5 did not absorb as much water as layups 2-4 and absorbed approximately as much water as layup #1, as determined by measuring the weight of each layup before and after soaking. These results show that the thermal layer of layup #5 did not have a propensity to absorb water. Together with the prior test results, these results also show that layup #5 provides increased thermal protection performance while reducing the possibility for inducing fatigue by a wearer by not having to carry extra weight ordinarily caused by absorption of liquids during use.

In another series of tests, a baseline test layup #1 includes an approximately 0.50 mm thick aluminized PBI/Kevlar® outer layer, a Gore® RT7100 barrier layer, and an 8 oz self extinguishing fleece inner layer. The uncompressed thickness of layup #1 measured 1.35 mm, while the compressed thickness measured 1.10 mm. The TPP for this layup measured 23.8. By contrast, layup #2 is identical to layup #1 except layup #2 includes a thermal layer of Gore® T-4999 tape positioned between the Gore® RT7100 barrier layer and the aluminized PBI/Kevlar® outer layer. The uncompressed and compressed thickness measurements increased modestly to 1.70 mm and 1.40 mm, respectively, as compared to layup #1, but the measured TPP doubled to approximately 42.2, which represents an increase in TPP of approximately 77%. Because a TPP of 30-35 is likely to meet the performance standards set by OSHA, Cal/OSHA, and/or the NFPA®, this test shows that the use of thermal layer 60 comprising Gore® tape Model T-4999 or any material having physical and/or mechanical properties similar to Gore® tape Model T-4999 in combination with an otherwise substandard combination of glove layers nevertheless meets the performance standards set by these organizations while permitting a substantially thinner glove thickness than previously known thereby maximizing a wearer's dexterity.

In another series of tests to characterize selected mechanical properties of thermal layer 60, two layups were tested for puncture and abrasion resistance in accordance with ANSI/ISEA 105 using test methods EN 388:2003 for puncture resistance and ASTM D3389-05 for abrasion resistance. Prior to testing, each layup was conditioned at 23+2° C. and 50+5% RH for 24 hours.

Testing of a first, baseline layup comprising a self extinguishing fleece inner layer together with a barrier layer comprising Gore® RT7100, resulted in this layup having a measured puncture resistance of 9.39 N and a measured abrasion resistance of 61 cycles using a 500 gram load. By comparison, the testing of a second layup comprising a self extinguishing fleece inner layer, a barrier layer comprising Gore® RT7100, and a thermal layer comprising Gore® T-4999 tape resulted in a measured puncture resistance of 21.35 N and a measured abrasion resistance of 142 cycles using a 500 gram load. The puncture resistance represents the maximum compressive load that the respective layup can withstand before puncture occurs. The weight of each layup before and abrasion testing was also measured. For the first, baseline layup, the weight before abrasion testing measured 5.82 grams and the weight after abrasion testing measured 5.79 grams. For the second layup, the weight before abrasion testing measured 7.64 grams and the weight after abrasion testing measured 7.60 grams. Thus, the weight difference of each respective layup before and after the abrasion tests was approximately the same for both layups, but the number of cycles for the second layup was substantially higher than the baseline layup. Thus, the second layup performed substantially better in terms of puncture resistance and abrasion resistance than the baseline layup.

Figure 5:
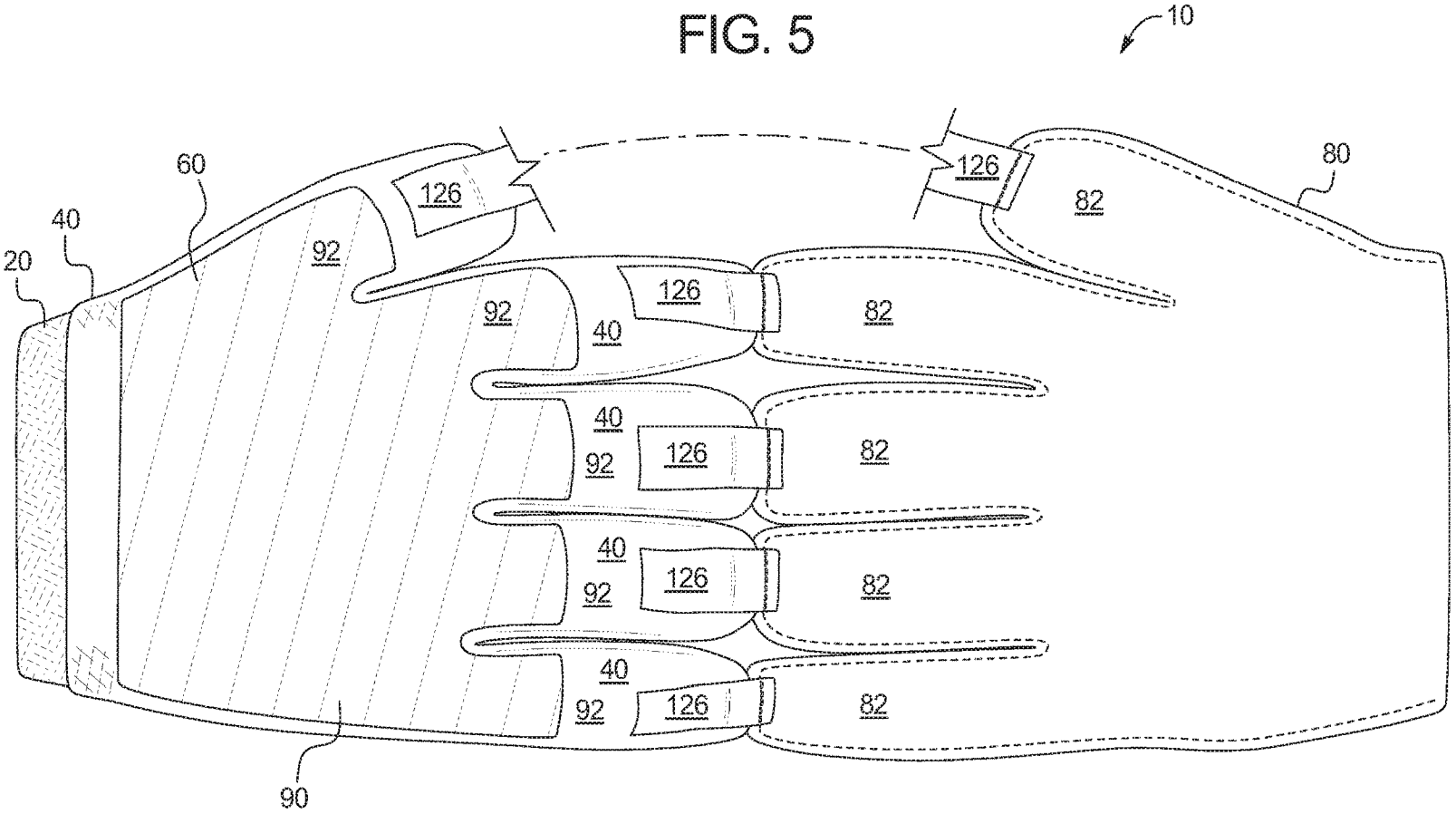
FIG. 5 is a plan view of the embodiment of the multi-layer glove of FIG. 2.
Figure 6:
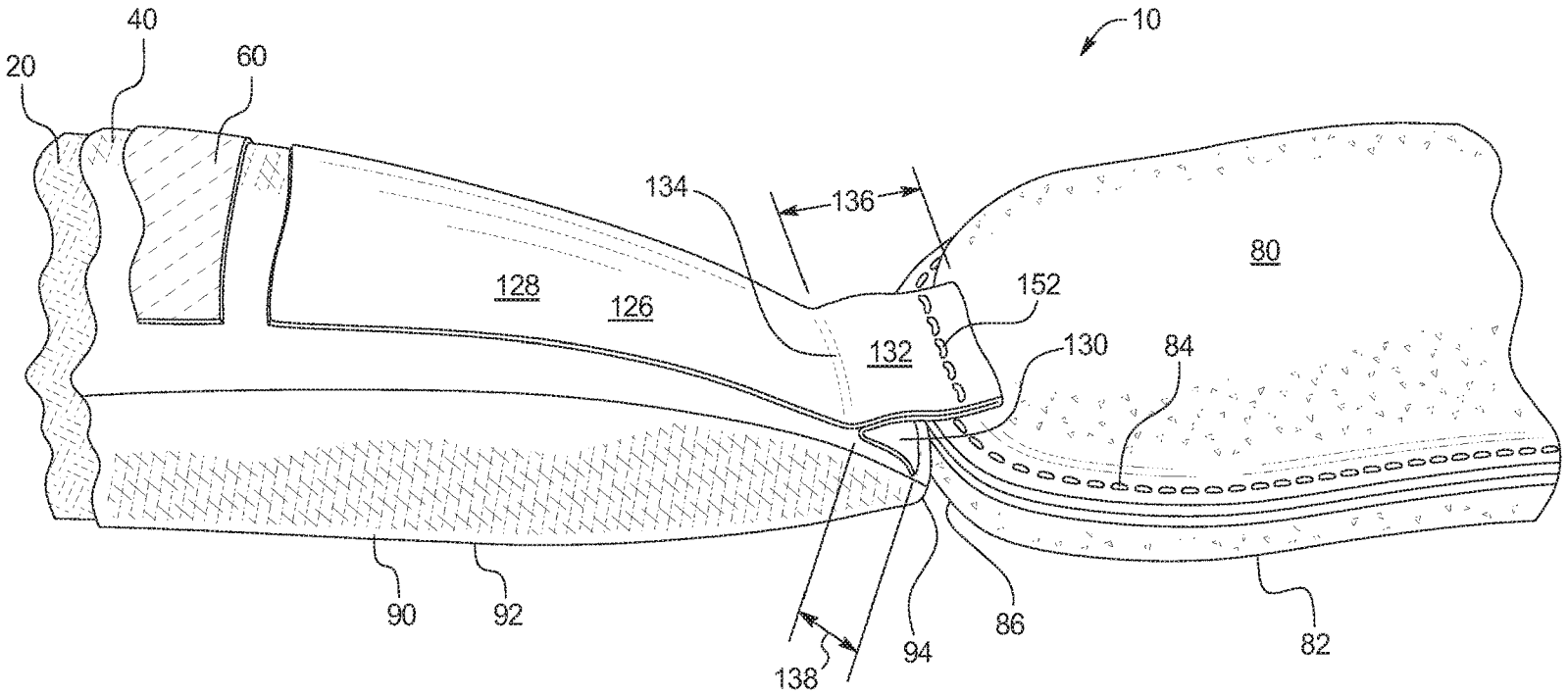
FIG. 6 is a partial perspective view of the embodiment of FIG. 5.

Turning to FIGS. 5-6, an embodiment of thermal layer 60 is shown covering at least the top, bridge side of the glove and extending partially down finger portions 92 of inner portion 90. A wearer's knuckles would be shielded from heat in this configuration without significantly impeding breathability of a glove or garment system if thermal layer 60 is not as breathable as other layers. Thermal layer 60 may cover a smaller or greater area than what is notionally depicted in the figures. For example, thermal layer 60 may extend to at least the fingertips of finger portions 92 of inner portion 90 and/or to at least wrist portion 18. Thermal layer 60 may be die-cut from a pattern. Two or more portions of thermal layer 60 may be stitched together.

To join outer layer 80 to inner portion 90, glove 10 may include attachment tab 126, which may lie adjacent to an end point of thermal layer 60. If present, one end of attachment tab 126 is affixed to the outer surface of one side, such as the top or knuckle side, of each finger portion 92 of inner portion 90 using an adhesive. Another end of attachment tab 126 is attached to each inverted finger portion 82 of outer layer 80 using stitches 152 along stitch line 84. Attachment tab 126 may comprise the same material as described above for thermal layer 60.

Attachment tab 126 may alternatively be attached to any other side of finger portion 92, such as the fingerprint/finger pad side of finger portion 92 or one of the opposed sides of finger portion 92. In other embodiments, attachment tab 126 may be affixed to other portions or surfaces of a glove layer, such as inner portion 90.

Attachment tab 126 may comprise lower portion 128, upper portion 130, and extension portion 132. As best shown in FIG. 6, attachment tab 126 is attached to inner portion 90 along lower portion 128 and upper portion 130 while extension portion 132 is attached to outer layer 80. Extension portion 132 is configured to overlie upper portion 130 and to extend from attachment tab 126 at attachment point 134 positioned distally from fingertip 94 of inner portion 90 to an attachment point proximate fingertip 86 of inverted outer layer 80, optionally along stitch line 84 of outer layer 80.

In another embodiment, attachment tab 126 comprises lower portion 128 and extension portion 132, but no upper portion 130. Extension portion 132 may be configured to extend from attachment tab 126 at attachment point 134 positioned at or near, or alternatively, distally from fingertip 94 of inner portion 90 to an attachment point proximate fingertip 86 of inverted outer layer 80, optionally along stitch line 84 of outer layer 80. Attachment tab 126 may be affixed to inner portion 90 along lower portion 128 using, for example, an adhesive. In another embodiment, extension portion 132 extends from attachment tab 126 at attachment point 134 to any stitch line on outer layer 80.

Referring again to FIG. 6, length 136 of extension portion 132 may vary depending on the distance of attachment point 134 on inner portion 90 relative to fingertip 94 of inner portion 90. As the distance increases or decreases, which distance is associated with length 138 of upper portion 130, length 136 of extension portion 132 correspondingly increases or decreases. In the embodiment shown in FIG. 6, length 136 is slightly longer than length 138 of upper portion 130 to position stitches 152 at the end of extension portion 132 to cause fingertip 86 of adjacent outer layer 80 to be substantially near or in contact with fingertip 94 of inner portion 90 when outer layer 80 is inverted over inner portion 90. Said another way, length 136 of extension portion 132 relative to length 138 and relative to fingertip 94 of inner portion 90 minimizes or eliminates internal clearance with fingertip 86 of outer layer 80 to improve the dexterity of a wearer's fingers along with the "feel" and gripping ability of the wearer. In addition, by positioning attachment point 134 distally from fingertip 94 of inner portion 90, as shown in FIG. 6, length 136 of extension portion 132 provides a needleworker with material from which to manipulate and comfortably separate the adjacent layers to easily stitch, for example, them together using stitches 152 at stitch line 84. In another embodiment, attachment point 134 is positioned distally from fingertip 94 past the approximate location of the wearer's first knuckle. Length 136 in this embodiment would therefore increase to allow the distal end of extension portion 132 to extend to finger portion 82 of outer layer 80 where stitches 152 may be utilized to connect inner portion 90 to outer layer 80 along, for example, stitch line 84. Attachment tab 126 may instead be configured to attach to either or both the fingerpad and knuckle sides of finger portion 92, with extension portion 132 extending to finger portion 82 from a point at or near finger tip 94.

The completed structure illustrated in FIGS. 1-2, for example, is obtained by inverting outer layer 80 so that its outer surface faces outwardly and its inner surface overlies the outer surfaces of inner portion 90. Wrist portion 18 may be created by adding a cuff, a wristlet, or a gauntlet portion either before or after overturning outer layer 80. In the embodiments shown in the figures, attachment tab 126 comprises the same material as thermal layer 60. Attachment tab 126 may alternatively comprise any of a number of materials, such as a fabric or a plastic, affixed to inner portion 90 either by an adhesive, heat sealing or stitching to inner portion 90.

Turning again to FIG. 3, there is shown another embodiment of a multi-layer glove. As described above for glove 10, glove 100 includes inner layer 20, barrier layer 40, thermal layer 60, and outer layer 80. Inner layer 20 is the innermost layer over which lies barrier layer 40. Thermal layer 60 is shown as lying over barrier layer 40, and outer layer 80 is shown as lying over thermal layer 60 to form glove 10.

Barrier layer 40 of glove 100 is affixed or otherwise laminated to inner layer 20 using adhesive 42 to form inner portion 120. Thermal layer 60 of glove 100 is affixed to outer layer 80 using adhesive 62 to form outer portion 110. As described above for glove 10, to minimize bulk of glove 100 and to maintain flexibility and dexterity of a wearer of glove 100, thermal layer 60 may include Gore® tape Model T-4999 without dry edge, or any material having similar physical and mechanical properties as Gore® tape Model T-4999. In other embodiments where no barrier layer 40 exists, thermal layer 60 may lie between inner layer 20 and outer layer 80, and may be affixed or laminated to either inner layer 20 or outer layer 80.

To join outer portion 110 to inner portion 120, glove 100 may include attachment tab 126 affixed to one another as previously described for glove 10. Once connected together, inverted outer portion 110 is then folded over inner portion 120. Although gap 50 is notionally shown therebetween, inner surfaces of outer portion 110 and outer surfaces of inner portion 120 may be and likely are in contact with one another, depending on the dimensions and tolerances of the patterns associated with outer portion 110 and inner portion 120. As before, wrist portion 18 may be created by adding a cuff, a wristlet, or a gauntlet portion either before or after overturning outer portion 110.

While specific embodiments have been described in detail, it will be appreciated by those skilled in the art that various modifications and alternatives to those details could be developed in light of the overall teachings of the disclosure. Accordingly, the disclosure herein is meant to be illustrative only and not limiting as to its scope and should be given the full breadth of the appended claims and any equivalents thereof.

What is claimed is:

1. A glove comprising a palm portion, a dorsal portion opposite the palm portion, and a plurality of finger portions, the glove configured for use in hazardous environments, the dorsal portion of the glove comprising:

a first layer comprising a flame inhibiting material;

a second layer connected to the first layer; and a third layer comprising an adhesive tape that is affixed to the first layer or the second layer and covers the dorsal portion of the glove from one lateral side of the dorsal portion of the glove to an opposing lateral side of the dorsal portion of the glove, wherein the adhesive tape comprises a durable laminate with a pressure sensitive adhesive.

2. The glove of claim 1, wherein the first layer comprises a self extinguishing fleece.

3. The glove of claim 1, wherein the first layer comprises a woven, a nonwoven, or a knit material.

4. The glove of claim 1, wherein the second layer comprises a leather.

5. The glove of claim 1, wherein the second layer comprises a canvas.

6. The glove of claim 1, wherein the second layer comprises poly para-phenyleneterephthalamide.

7. The glove of claim 1, wherein the second layer comprises an approximately 0.50 mm thick aluminized material comprising a blend of polybenzimidazole synthetic fibers and poly para-phenyleneterephthalamide synthetic fibers.

8. The glove of claim 1, wherein the adhesive tape is 0.20 to 0.35 mm thick and includes adhesive on one side.

9. The glove of claim 1, wherein each of the plurality of finger portions includes an attachment tab stitched to the second layer, at least one attachment tab comprises an attachment adhesive tape, and the attachment adhesive tape and the adhesive tape of the third layer are formed of the same material.

10. A glove comprising a palm portion, a dorsal portion opposite the palm portion, and a plurality of finger portions, the glove configured for use in hazardous environments, at least one of the dorsal portion of the glove and the palm portion of the glove comprising:

a first layer comprising a woven, a nonwoven, or a knit material and a thermal layer affixed to and immediately adjacent the first layer, the thermal layer comprising an adhesive tape; and a second layer attached to and overlying the first layer to form an outer portion of the glove, wherein the adhesive tape is 0.20 to 0.35 mm thick and includes adhesive on one side.

11. The glove of claim 10, wherein the first layer is flame resistant.

12. The glove of claim 10, wherein the second layer comprises a leather.

13. The glove of claim 10, wherein the second layer comprises a canvas.

14. The glove of claim 10, wherein the second layer comprises poly para-phenyleneterephthalamide.

15. A glove comprising a palm portion, a dorsal portion opposite the palm portion, and a plurality of finger portions, the glove configured for use in hazardous environments, at least one of the dorsal portion of the glove and the palm portion of the glove comprising:

a first layer comprising a woven, a nonwoven, or a knit material and a thermal layer affixed to and immediately adjacent the first layer, the thermal layer comprising an adhesive tape; and a second layer attached to and overlying the first layer to form an outer portion of the glove, wherein each of the plurality of finger portions includes an attachment tab stitched to the second layer, at least one attachment tab comprises an attachment adhesive tape, and the attachment adhesive tape and the adhesive tape of the thermal layer are formed of the same material.

16. The glove of claim 15, wherein the first layer is flame resistant.

17. The glove of claim 15, wherein the second layer comprises at least one of a leather, a canvas, and poly para-phenyleneterephthalamide.

18. A glove comprising a palm portion, a dorsal portion opposite the palm portion, and a plurality of finger portions, the glove configured for use in hazardous environments, at least one of the dorsal portion of the glove and the palm portion of the glove comprising:

a first layer comprising a woven, a nonwoven, or a knit material and a thermal layer affixed to and immediately adjacent the first layer, the thermal layer comprising an adhesive tape; and a second layer attached to and overlying the first layer to form an outer portion of the glove, wherein the adhesive tape comprises a durable laminate with a pressure sensitive adhesive.

19. The glove of claim 18, wherein the first layer is flame resistant.

20. The glove of claim 18, wherein the second layer comprises at least one of a leather, a canvas, and poly para-phenyleneterephthalamide.

* * * * *